US005988267A

United States Patent [19]

Park et al.

[11] Patent Number: 5,988,267

[45] Date of Patent: Nov. 23, 1999

[54] MULTISTAGE GAS AND LIQUID PHASE SEPARATION TYPE CONDENSER

[75] Inventors: Tae Young Park; Kwang Heon Oh, both of Taejon, Rep. of Korea

[73] Assignee: Halla Climate Control Corp., Taejon, Rep. of Korea

[21] Appl. No.: 09/097,482

[22] Filed: Jun. 15, 1998

[30] Foreign Application Priority Data

Jun. 16, 1997 [KR] Rep. of Korea ..... 97-24918
May 2, 1998 [KR] Rep. of Korea ..... 98-15867

[51] Int. Cl.[6] ..... F25B 1/00; F25B 39/04

[52] U.S. Cl. ..... 165/110; 165/144; 165/174; 165/176; 62/509

[58] Field of Search ..... 165/110, 144, 165/145, 174, 176; 62/509

[56] References Cited

U.S. PATENT DOCUMENTS 5,203,407 4/1993 Nagasaka ..... 165/174
5,228,315 7/1993 Nagasaka et al. ..... 62/509
5,752,566 5/1998 Liu et al. ..... 165/110

FOREIGN PATENT DOCUMENTS 103612 4/1995 Japan .
180930 7/1995 Japan .
183325 7/1996 Japan .

*Primary Examiner*—Leonard Leo
*Attorney, Agent, or Firm*—Ladas & Parry

[57] ABSTRACT

A multistage gaseous and liquid phase separation type condenser has a pair of headers disposed in parallel with each other, and a plurality of flat tubes each connected to the headers at opposite ends thereof and corrugated fins interposed between adjacent flat tubes. Each header is divided by baffles into four chambers. The second header has a receiver and chambers of the second header have communication passageways for placing the chambers of the second header in flow communication with the receiver. The first header has an inlet pipe connected to a middle chamber thereof so as to form an inlet path and an outlet pipe connected to a lower chamber thereof. While the refrigerant flows through the paths defined by a plurality of flat tubes, a first separation of gaseous and liquid phases of the refrigerant occurs within the second header so that the separated gaseous refrigerant is recondensed flowing through an upper path above the inlet path and introduced into the receiver via the communication passageway, whereas the separated liquid refrigerant is introduced into the receiver. A second separation of gaseous and liquid phases of the refrigerant occurs within the receiver in connection with a certain amount of the liquid refrigerant stored in the receiver. The liquid refrigerant in the receiver is communicated with the lower path via a lower communication passageway formed in the lower chamber of the second header.

33 Claims, 8 Drawing Sheets

MULTISTAGE GAS AND LIQUID PHASE SEPARATION TYPE CONDENSER

BACKGROUND OF THE INVENTION

1. Field of the Invention

This invention relates to a heat exchanger, and more particularly to a multi separation type condender of the gaseous and liquid phases of the refrigerant.

2. Prior Art

Many heat exchangers as one of vehicle-loaded condenser utilize the parallel flow or multiflow type condenser in which the refrigerant flows in a zigzag pattern within the condenser along a plurality of paths defined between the two header pipes. As shown in FIG. 1, the heat exchanger of parallel flow type such as the one embodied in the form of a condenser 10 conventionally comprises a plurality of flat tubes 11 and corrugated fins 12 stacked alternately between adjacent flat tubes, a first header 13 to which the flat tubes 11 are connected at one ends thereof, and a second header 14 to which the flat tubes are connected at the other ends thereof. The condenser 10 also has a pair of side plates 20 and 21 disposed at the outermost thereof, and both ends of each of the headers 13 and 14 are closed by blind caps 17 and 18. An inlet pipe 15 is connected to the first header 13 adjacent its upper end and an outlet pipe 16 is connected adjacent its lower end. The outlet pipe 16 may be connected to the second header 14 differently from FIG. 1. Such location of the inlet/outlet pipe may be determined in relation with the number of paths formed.

Both the first and second header 13 and 14 are provided with baffles to define a plurality of paths each defined by a plurality of flat tubes 11. FIG. 1 shows four paths formed and the number of paths varies with increase or decrease of the baffles. In the multiflow type condenser, the refrigerant flows in zigzag fashion between the inlet pipe 13 and the outlet pipe 16.

The refrigerant introduced into the condenser 10 provided with the above-mentioned construction is condensed into a liquid state and delivered toward an external receiver 22 via a conduit connected to the outlet pipe 16 and then, stored therein. The receiver 22 maintains a certain volume of refrigerant so as to deal with rapid change of the amount of refrigerant in, for example, an automotive refrigeration systems according to variations of the load. The receiver is normally provided with a desiccant and/or a filter for removing water and dust from the condensed refrigerant.

With a conventional refrigerant system, the condenser and the receiver are separately provided and communicated with each other via a conduit so as to have disadvantages of a large mounting space and added cost. Further, since the refrigerant flows within the condenser in a zigzag fashion in a state of coexistence of two phases of gas and liquid of the refrigerant, it is hard to obtain a condensing effect utilizing separation of the gaseous and liquid phases of the refrigerant within the condenser.

SUMMARY OF THE INVENTION

It is an object of the present invention to provide a multistage gas and liquid phase separation type condenser in which one of a pair of headers is provided with a receiver, the first separation of the gas and liquid phases of the refrigerant occurs in the headers from the condensation-progressed refrigerant traveling through paths of the condenser, and the second separation of the gas and liquid phases of the refrigerant occurs in a receiver by passing the recondensed and/or condensed refrigerant, which may contain a gaseous refrigerant, into the receiver through communication passageways provided with between the header with the receiver and the receiver so as to allow the refrigerant exiting the condenser to maintain substantially a liquid state.

It is another object of the present invention to provide a multistage gas and liquid phase separation type condenser to cope with rapid change of volume of the refrigerant due to variation of heal exchanging load in a refrigerant circuit for use, for example, in an automotive air conditioning system.

It is another object of the present invention to provide a multistage gas and liquid phase separation type condenser in which by providing one of a pair of headers with a receiver and the other with a bypass conduit, ① in terms of the receiver, the first separation of the gas and liquid phases of the refrigerant occurs in the headers from the condensation-progressed refrigerant passing through paths of the condenser, and the second separation of the gas and liquid phases of the refrigerant occurs in the receiver by passing the recondensed and/or condensed refrigerant, which may contain a gaseous refrigerant, into the receiver through communication passageways provided with between the header with the receiver and the receiver so as to permit the refrigerant exiting the condenser to maintain substantially a liquid state, and ② by means of the bypass conduit, the refrigerant passage resistance in flow of the refrigerant through the condenser paths, especially the flat tubes, is reduced by allowing some of the condensed liquid refrigerant to directly bypass from chamber to chamber formed in the header without passing through the entire paths.

A multistage gas and liquid phase separation type condenser in accordance with the present invention comprising:

a first header having at least three chambers;

a second header having at least two chambers and disposed in parallel with said first header;

a plurality of tubes each connected to said headers at opposite ends thereof;

a plurality of fins each fin disposed between adjacent tubes;

a receiver provided with one of the headers;

a refrigerant inlet provided with a middle chamber of said first header;

a refrigerant outlet provided with one of said headers or said receiver;

the refrigerant being introduced through said inlet and exiting the condenser through said outlet;

the refrigerant flowing through a first path defined through a plurality of tubes, a second path located above said first path and defined through a plurality of tubes for recondensing a gaseous refrigerant of the refrigerant passed through said first path, and a third path located below said first path and defined through a plurality of tubes for allowing a liquid refrigerant of the refrigerant passed through said first path to flow therethrough;

a first separation of gaseous and liquid phases of the condensation-progressed refrigerant passing through said first path occurring within said second header so that the separated gaseous refrigerant is recondensed flowing through said second path and thereafter introduced into said receiver via an upper communication passageway provided between an upper chamber of the header with said receiver and said receiver, while the separated liquid refrigerant flows through said third path toward said outlet;

a fluid communication between said receiver and the header with said receiver being made via a lower communication passageway provided between a lower chamber of the header with said receiver and said receiver; and a second separation of gaseous and liquid phases of the refrigerant introduced into said receiver occurring in connection with a certain amount of the liquid refrigerant existing within said receiver.

These and other features, objects and advantages of the invention will be apparent from the following description of preferred embodiments thereof taken with the accompanying drawings.

DESCRIPTION OF THE PREFERRED EMBODIMENTS

Figure 1:
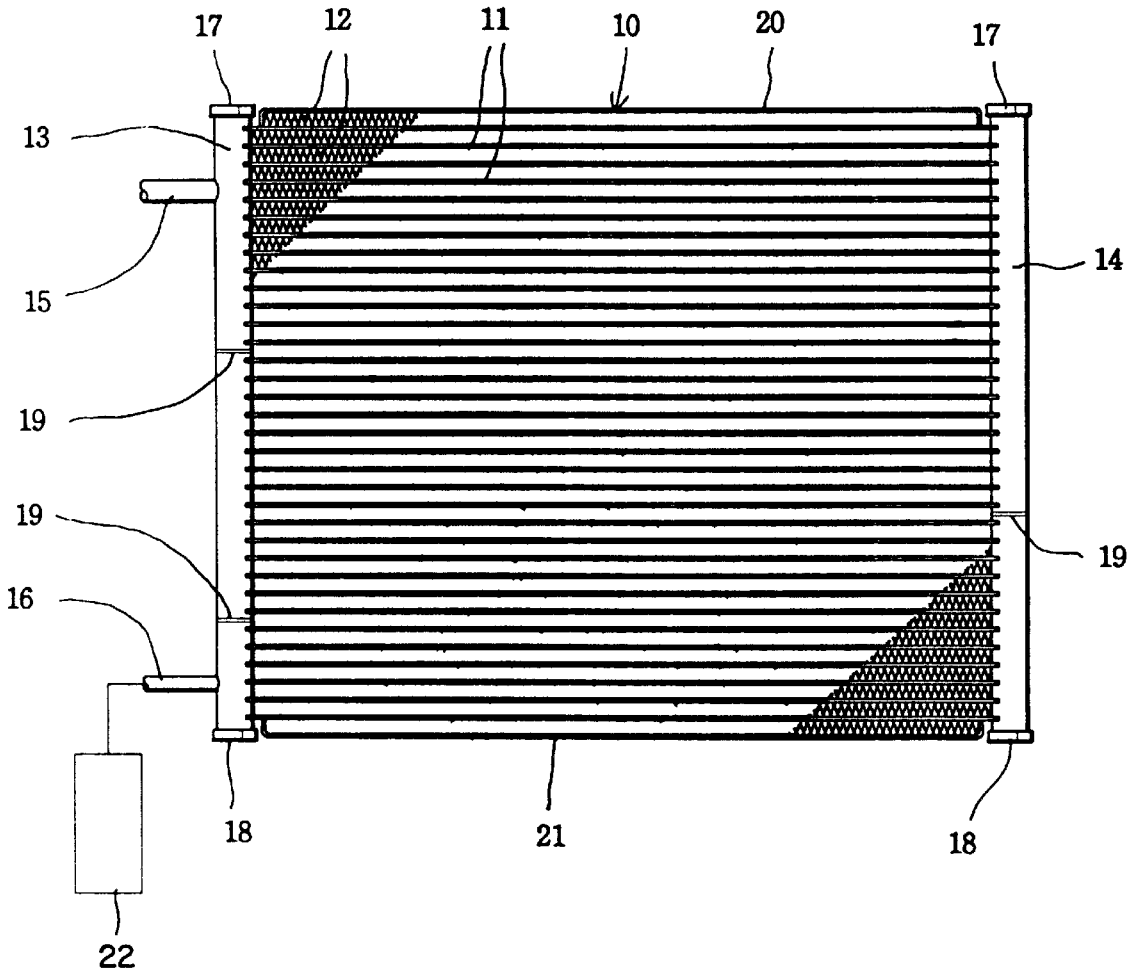
FIG. 1 PRIOR ART
FIG. 1 is a front view showing a prior art condenser.
Figure 2:
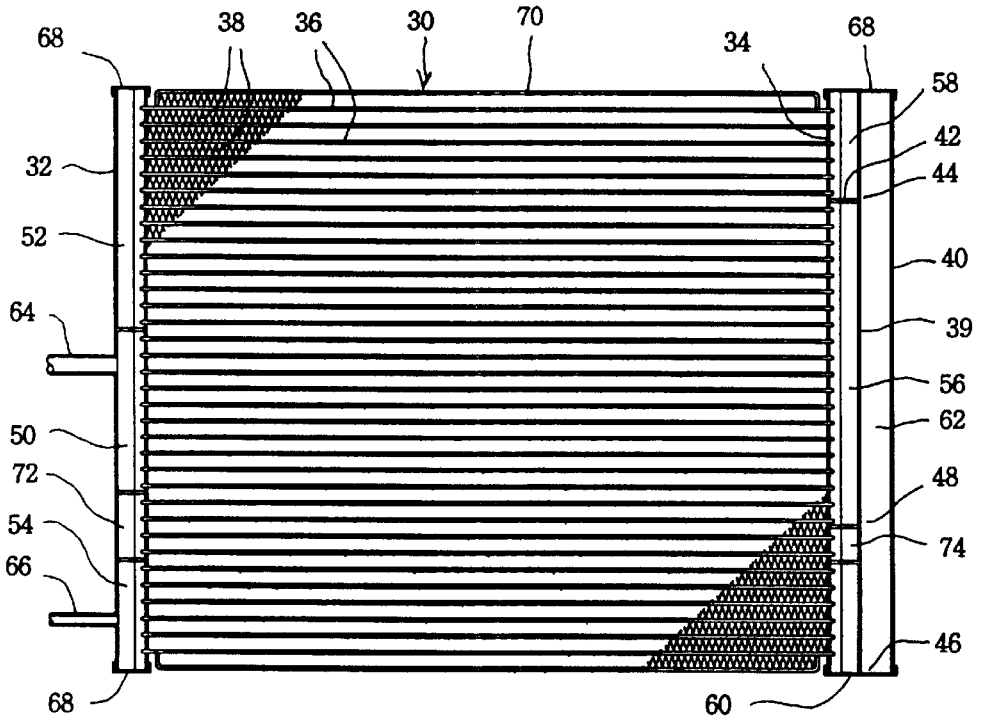
FIG. 2 is an entire cross-sectional view of a multistage gas and liquid phase separation type condenser according to an embodiment of the present invention.

FIGS. 1 and 2 illustrate the first embodiment of the invention.

A multistage gas and liquid phase separation type condenser 30 of this embodiment comprises, as seen in FIG. 1, a first header 32 and a second header 34. As depicted in FIG. 1, each of the headers 32 and 34 consists of two components, and however the configuration of the headers 32 and 34 is not restricted thereto. In case of the headers consitsing of two components (see, e.g., FIG. 8), each tube is commonly comprised of two pieces, an upper portion for connecting an inlet and/or outlet pipe and a lower portion for insertion of flat tubes both components substantially forming together an elliptical cross-section. For the condenser according to the present invention, the headers are not restricted to the above-mentioned structure and cylindrical headers can also be employed. A plurality of flat tubes 36 are arranged in parallel with one another between the first and second headers 32 and 34 and connected to the headers 32 and 34 through slots formed in the headers at their opposite ends. A plurality of corrugated fins are interposed between respective pairs of adjacent flat tubes 36. A receiver 40 is provided with the second header 34. The condenser 30 further comprises a pair of side plates disposed at the outmost positions. Both ends of each of the first header 32 and the second header 34 with the receiver 40 are closed by blind caps 68.

Figure 3:
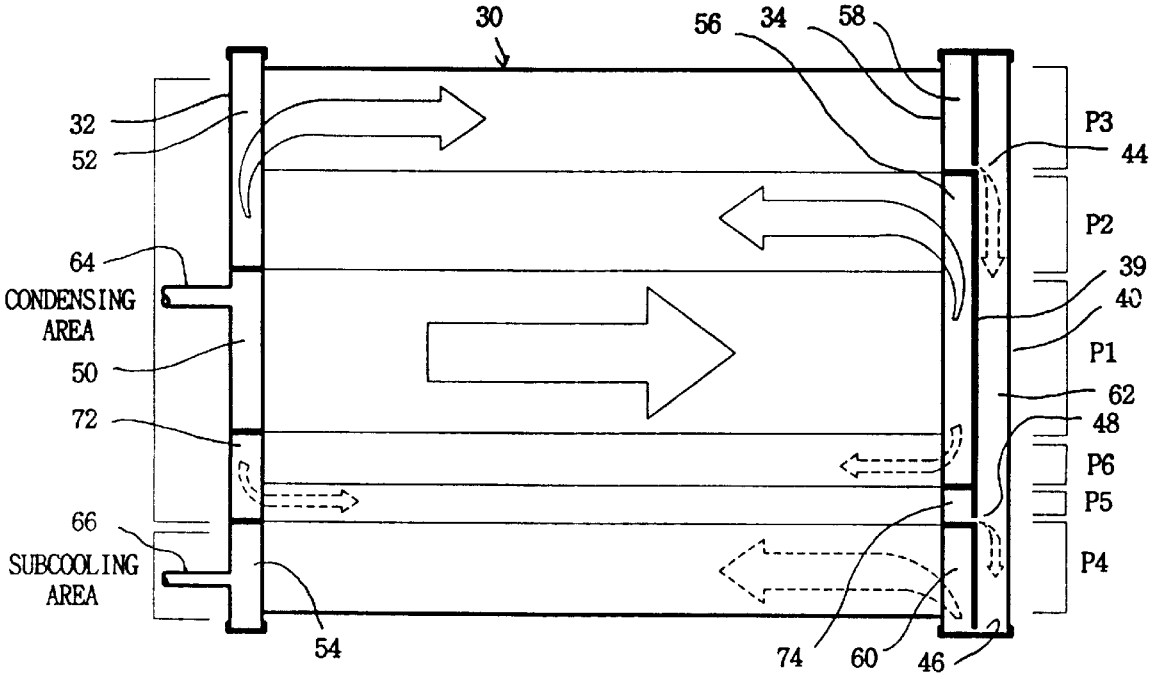
FIG. 3 is a schematic view illustrating flow of the refrigerant in the condenser of FIG. 1.

Each header 32, 34 is provided with partitioning means for dividing the inside space thereof, in this embodiment baffles 42 so that a plurality of refrigerant paths are defined in a relation between the first and second headers 32 and 34 and a plurality of flat tubes 36. Because of provision of the baffles 42, the headers 32, 34 are provided with a plurality of chambers and the refrigerant flows in a zigzag pattern through the paths within the condenser 30. In FIGS. 2 and 3, each header 32, 34 is provided with three baffles 42 and adjustment of the number of baffles 42 results in change of the paths in their numbers. It should be understood that division of the inside space of each header into several chambers may be made by accumulating chambered members each having internal cavity and sealed at one or both ends, and then by brazing the chambered members.

Three baffles 42 are disposed in the first header 32 in a nonuniform spaced apart relationship and divide the internal space thereof into top, middle, bottom and additional chambers 52, 50, 54 and 72, respectively. A wall 39, which corresponds to some portion of an exterior surface of the second header 34, defines the boundary between the second header 34 and the receiver 40. Three baffles 42 are located in the second header 34 in a nonuniform spaced apart relationship and divide the internal space thereof into upper, central, lower and additional chambers 58, 56, 60 and 74, respectively. Openings formed in upper, middle and lower portions of the wall 39 in connection with the upper, additional and lower chambers 58, 74 and 60 of the second header 34 serve as upper, middle and lower communication passageways 44, 48 and 46, respectively. The second header 34 and the receiver 40 are communicated with each other through the communication passageways 44, 46 and 48 so that flow communication of the refrigerant is accomplished between the second header 34 and the receiver 40. Further, a reservoir 62 is provided for storing the refrigerant discharged from the second header 34 between the wall 39 and the receiver 40. An inlet pipe 64 for introducing the refrigerant gas from an external compressor into the condenser 30 is connected to the middle chamber 50 of the first header 32, and an outlet pipe 66 for discharging the refrigerant toward an external climate control system is connected to the first header 32 adjacent its lower end, i.e., the bottom chamber 54.

Referring to FIGS. 2 and 3, FIG. 3 is a schematic view illustrating flow of the refrigerant in the condenser of FIG. 1. In this embodiment the condenser 30 has six paths from P1 to P6. Each path P1 to P6 is defined by both chambers 50, 52, 54, 56, 58, 60, 72 and 74 of the headers 32, 34 and a plurality of flat tubes disposed therein. Since the inlet pipe 64 is connected to the middle chamber 50 of the first header 32, a first inlet path P1 is defined from the middle chamber 50 of the first header 32 through a plurality of flat tubes 36 arranged in the middle chamber 50 toward the second header 34. Passing through the inlet path P1, the gaseous refrigerant undergoes condensation and is changed from the gaseous state into the gas/liquid two-phase state.

While the gaseous refrigerant travels upward because of its very active movement and buoyancy due to density difference from the liquid refrigerant, the liquid refrigerant moves downward under the influence of gravity due to high viscosity and large mass and density as compared with the gaseous refrigerant. Accordingly, the gaseous refrigerant flows through a plurality of flat tubes 36 which define upper paths P2 and P3 placed above the inlet path P1. The gaseous refrigerant is progressively recondensed passing through the upper paths P2, P3 and supplied to the receiver 40 through the upper communication passageway 44 formed in the upper chamber 58 of the second header 34. In the meantime, the liquid or liquid/cool gaseous refrigerant passed through the inlet path P1 is recondensed and/or subcooled flowing through lower paths P5, P6 below the inlet path P1 and discharged into the receiver 40 through the middle communication passageway 48 formed in the additional chamber 74 of the second header 34. In the embodiment of FIGS. 2 and 3, no communication passageway is formed in the central chamber 56 of the second header 34. As described above the refrigerant gas is condensed to a liquid state as it travels through the refrigerant paths P1 to P3, P5 and P6 and stored in the receiver 40. The liquid refrigerant in the receiver 40 flows through an outlet path P4 via the lower communication passageway 46 providing a fluid communication between the receiver 40 and the second header 34, and then, exits the condenser 30 through the outlet pipe 66 toward an external climate control system. Arrows show the direction of flow of the refrigerant in which arrows in solid lines indicate flow of the gaseous refrigerant and arrows in dotted lines indicate flow of the liquid refrigerant.

In this embodiment of FIGS. 2 and 3, the inlet path P1, the upper paths P2, P3 and the lower paths P5, P6 define a condensing, area, while the outlet path P4 defines a subcooling area. A certain degree of subcooling is of course achieved in the lower paths P5, P6 because the liquid refrigerant flows mainly therethrough. The condensing area has a cross-sectional area corresponding to 70–80% of the overall effective cross-sectional area of the condenser, while the subcooling area has 20–30% of the overall effective cross-sectional area of the condenser. The inlet path P1 is arranged to have the largest effective cross-sectional area of the condensing area, preferably 30–50% thereof.

The refrigerant flowing through the outlet path P4 of the subcooling area maintains substantially a liquid state since the refrigerant stored in the receiver 40 has been changed sufficiently into a liquid state while traveling through the condensing area of the condenser 30. Further, the liquid refrigerant discharged from the receiver 40 into the lower chamber 60 of the second header 34 through the lower communication passageway 46 is prevented from rapidly flowing from the receiver 40 into the subcooling area and being swept along with the liquid refrigerant exiting through the outlet pipe 66 when the size of the lower communication passageway 46 is enough small. Enough small size of the passageway 46 makes it hard for the gaseous refrigerant maybe contained in the reservoir 62 to escape the lower communication passageway 46. Therefore, the gaseous refrigerant is scarcely introduced into the outlet path P4 of the subcooling area. Moreover, the receiver 40 has a given amount of the liquid refrigerant condensed passing through paths so that the gaseous refrigerant introduced into the receiver 40 is recondensed in connection with the liquid refrigerant stored in the receiver 40. In addition, the receiver 40 may include a desiccant and a filter for removing water and dust from the refrigerant. (not shown in FIGS. 2, 3)

In the embodiment of FIGS. 2 and 3, the sizes of the communication passageways 44, 46 and 48 formed between the second header 34 and the receiver 40 can be determined freely, and preferably decided to ensure that the gaseous refrigerant of the condensation-progressed refrigerant through the paths is not introduced into the receiver 40 as much as possible. Otherwise, each communication passageways may be sized in numeral. For example, the communication passageways formed in the condensing area of the condenser 30 (in this embodiment, the upper and middle communication passageways 44 and 48) may assume the shape of circular apertures or slits, and for the former shape the diameter thereof is preferably 1 to 8 mm. With the shape of slit, each width of openings formed by the slits is preferably 1 to 8 mm and the length of openings may be determined in response to the width of the openings. The communication passageway formed in the subcooling area of the condenser 30 (the lower communication passageway 46 in the present embodiment) may also assume the shape of circular apertures or slits, and for the former, the diameter thereof is preferably 8 to 13 mm. When the lower passageway 46 is the shape of slit, the width of opening formed by the slit is preferably 8 to 13 mm and the length of the opening may be sized corresponding to the width of the opening. The configuration and size of the communication passageways according to the embodiment of FIGS. 2 and 3 are applied to other embodiments of the present invention. The communication passageways 44, 46 and 48 are preferably located adjacent lower ends of respective chambers(58, 60 and 74). Moreover, more than one communication passageways may be provided with the respective chambers 58, 60 and 74.

For the condenser 30 according to the embodiment of FIGS. 2 and 3, the refrigerant gas is introduced from an external compressor and condensed, during passage through the inlet path P1, from the gaseous state into the gas/liquid two-phase state as the heat exchange occurs between the condenser and the atmospheric air flowing through the corrugated fins in the direction normal to a front plane of the condenser. Then, separation of the gaseous and liquid phases of the refrigerant takes place in the first place within the central chamber 56 of the second header 34. The separated gaseous refrigerant is introduced into the upper paths P2 and P3 above the inlet path P1 and the separated liquid refrigerant flows into the lower paths P5 and P6 below the inlet path P1. The gaseous refrigerant is recondensed into a liquid state as it travels through the upper paths P2 and P3, and further discharged into the receiver 40 via the upper communication passageway 44 provided with the upper chamber 58 of the second header 34. Some of the refrigerant stored in the receiver 40 may exist in a gaseous state, but such gaseous refrigerant is scarcely introduced into the second header 34 through the lower communication passageway 46 since the lower communication passageway 46 is enough small and a given amount of the liquid refrigerant is maintained in the receiver 40 after operation of a refrigerant system. The liquid refrigerant stored in the receiver 40 serves as a boundary surface between the gaseous refrigerant and the liquid refrigerant. Therefore, the refrigerant flowing through the outlet path P4 via the lower chamber 60 of the second header 34 maintains substantially a liquid state.

Consequently, phase separation effect between the gaseous refrigerant and the liquid refrigerant occurs again in the receiver 40. Even for the lower paths P5 and P6, though the gaseous refrigerant flows therethrough to some degree together with the liquid refrigerant, the gaseous refrigerant flows hardly through the outlet path P4 because the refrigerant having passed through the lower paths P5 and P6 travels through the outlet path P4 after outflow into the receiver 40.

Figure 4:
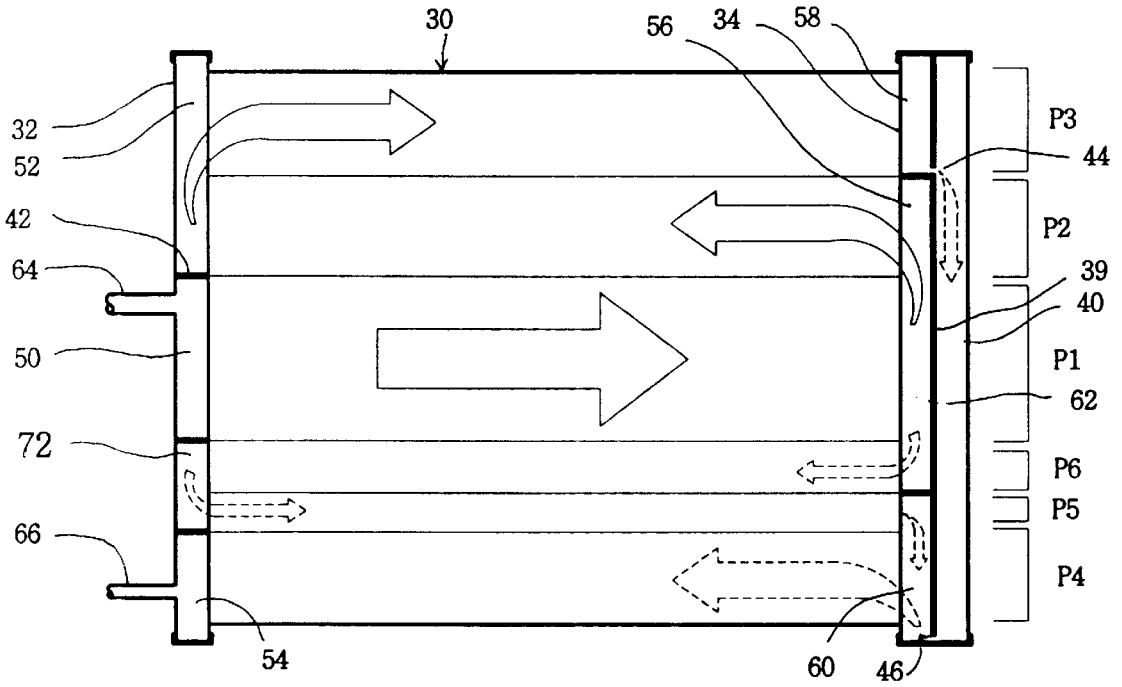
FIG. 4 is a schematic view of a multistage gas and liquid separation type condenser according to another embodiment of the present invention, illustrated in view of flow of the refrigerant on the basis of the condenser of FIG. 1.
Figure 5:
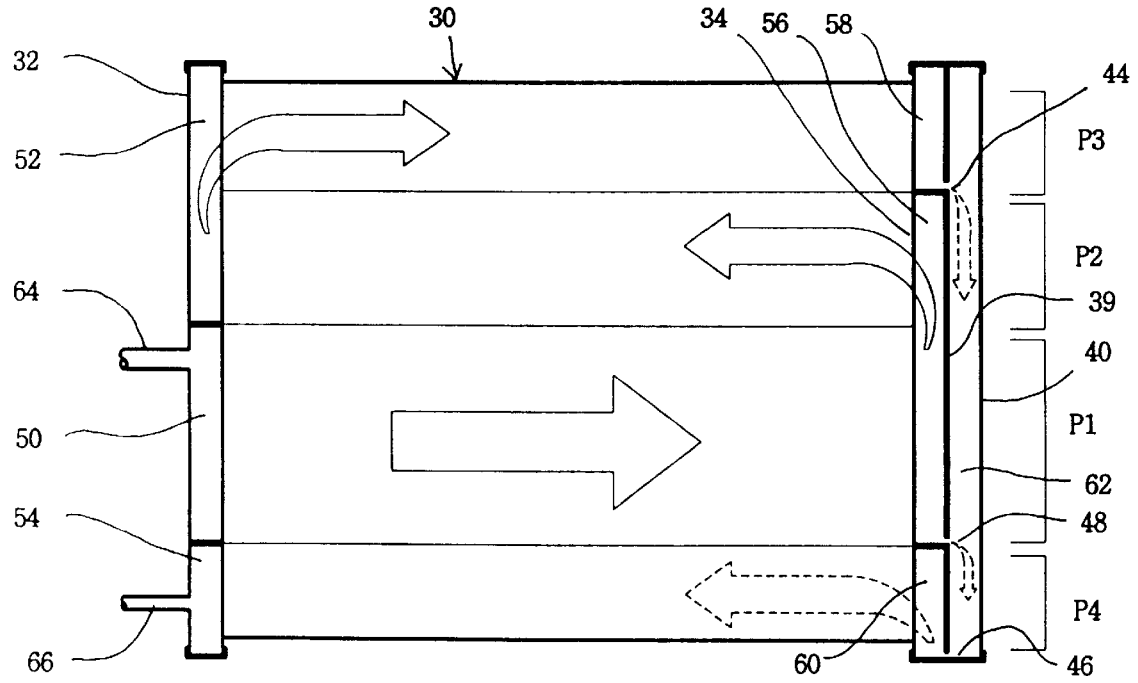
FIG. 5 is a schematic view of a multistage gas and liquid separation type condenser according to another embodiment of the present invention, illustrated in view of flow of the refrigerant on the basis of the condenser of FIG. 1.

FIGS. 4 and 5 are schematic view showing another embodiments of the present invention which are illustrated as schematic views because they base on the condenser according to the embodiment of FIGS. 2 and 3. That is, the condenser shown as FIGS. 4 and 5 are modifications of the embodiment of the condenser of FIGS. 2 and 3, wherein from the condenser of FIGS. 2 and 3, more than one baffle is removed or changed in its location, and according to such modifications, one of the communication passageways is eliminated or changed in its location. Therefore, explanation will be given putting emphasis on different features from the embodiment of FIGS. 2 and 3, and elements similar to elements of the condenser of FIGS. 2 and 3 are designated by like numerals.

Now the second embodiment of the present invention will be discussed.

FIG. 4 illustrates a multistage gas and liquid phase separation type condenser in schematic view. The condenser 30 in accordance with this embodiment differs from the condenser of the first embodiment in that the additional chamber 74 is not provided by removing the lowermost one of the baffles 42 disposed in the second header 34, and the middle communication passageway 48 is also removed so as to form only the upper and lower communication passageways 44 and 46. Other elements and constructions are identical to the condenser according to the first embodiment of FIGS. 2 and 3.

In operation of condenser 30, compressed refrigerant gas from an external compressor flows through the inlet path P1, and then, the first separation of the gaseous and liquid phases of the refrigerant occurs within the central chamber 56 of the second header 34. The gaseous refrigerant is recondensed flowing through the upper paths P2 and P3 above the inlet path P1, and supplied to the receiver 40 through the upper communication passageway 44 formed in the upper chamber 58 of the second header 34. In the meantime, the liquid or liquid/cool gaseous refrigerant passed through the inlet path P1 is recondensed and/or subcooled flowing through the lower paths P5 and P6 below the inlet path P1, and flows into the lower chamber 60 of the second header 34. The liquid refrigerant in the receiver 40 flows through the outlet path P4 via the lower communication passageway 46 formed in the lower chamber 60 of the second header 34.

Some of the refrigerant stored in the receiver 40 may exist in a gaseous state, but such gaseous refrigerant is scarcely introduced into the second header 34 through the lower communication passageway 46 since the lower communication passageway 46 is enough small and a given amount of the liquid refrigerant is maintained in the receiver 40 after operation of a refrigerant system. The liquid refrigerant stored in the receiver 40 serves as a boundary surface between the gaseous refrigerant and the liquid refrigerant. Therefore, the refrigerant flowing through the outlet path F4 via the lower chamber 60 of the second header 34 maintains substantially a liquid state. Consequently, phase separation effect between the gaseous refrigerant and the liquid refrigerant occurs again in the receiver 40. Even for the lower paths P5 and P6, though the gaseous refrigerant flows therethrough to some degree together with the liquid refrigerant, the gaseous refrigerant flows hardly through the outlet path P4 because the number of flat tubes constituting the lower paths P5 and P6 is few(see FIG. 2) and the outlet path P4 and the lower chamber 60 of the second header 34 are filled with the liquid refrigerant supplied from the lower paths P5 and P6 and the receiver 40.

With reference to FIG. 5, a condenser in accordance with the third embodiment of the present invention is shown. In this embodiment, the condenser differs from that in accordance with the first embodiment of FIGS. 2 and 3 in that a pair of baffles 42 constituting the additional chambers in each of the headers 32 and 34 are eliminated so as to remove the additional chambers 72 and 74. Accordingly, four paths of P1 to P4 are formed in the condenser 30 according to this embodiment. Three communication passageways of upper, middle and lower 44, 48 and 46 are provided with the condenser 30.

The refrigerant gas introduced from an external compressor into the condenser 30 flows through the inlet path P1, and then, the first separation between the gas and liquid phases of the refrigerant occurs within the central chamber 56 of the second header 34. The gaseous refrigerant is recondensed flowing through the upper paths P2 and P3 and introduced into the receiver 40 through the upper communication passageway 44. On the other hand, the liquid or liquid/cool gaseous refrigerant passed the inlet path P1 is discharged into the receiver 40 through the middle communication passageway 48 formed in the central chamber 56 of the second header 34. The liquid refrigerant flows from the receiver 40 through the outlet path P4 via the lower communication passageway 46 formed in the lower chamber 60 of the second header 34.

Some of the refrigerant stored in the receiver 40 may exist in a gaseous state, but such gaseous refrigerant is scarcely introduced into the second header 34 through the lower communication passageway 46 since the lower communication passageway 46 is enough small and a given amount of the liquid refrigerant is maintained in the receiver 40 after operation of a refrigerant system. The liquid refrigerant stored in the receiver 40 serves as a boundary surface between the gaseous refrigerant and the liquid refrigerant. Therefore, the refrigerant flowing through the outlet path F4 via the lower chamber 60 of the second header 34 maintains substantially a liquid state. Consequently, phase separation effect between the gaseous refrigerant and the liquid refrigerant occurs again in the receiver 40.

FIGS. 6 to 9 shows a multistage gas and liquid phase separation type condenser with a bypass conduit according to the fourth and fifth embodiments of the present invention, wherein the condenser in accordance with these embodiments base upon the condenser in accordance with the first embodiment of FIGS. 2 and 3, except addition of a bypass conduit which is connected to a header without having a receiver, and like numerals are used for like elements.

Figure 6:
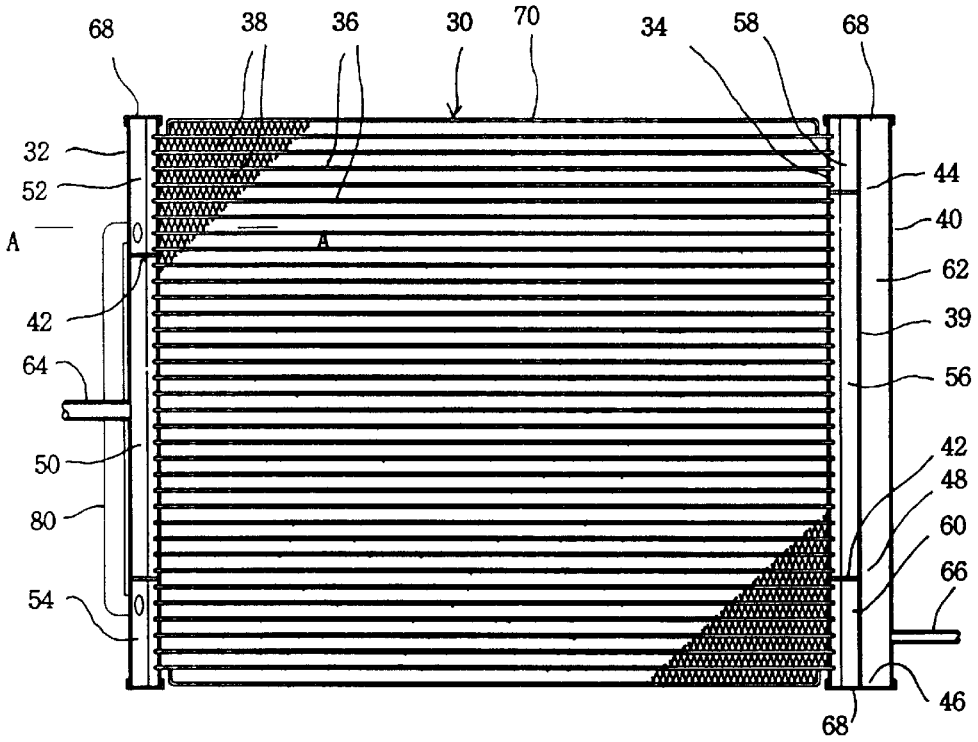
FIG. 6 is an entire cross-sectional view of a multistage gas and liquid phase separation type condenser according to further another embodiment of the present invention.
Figure 7:
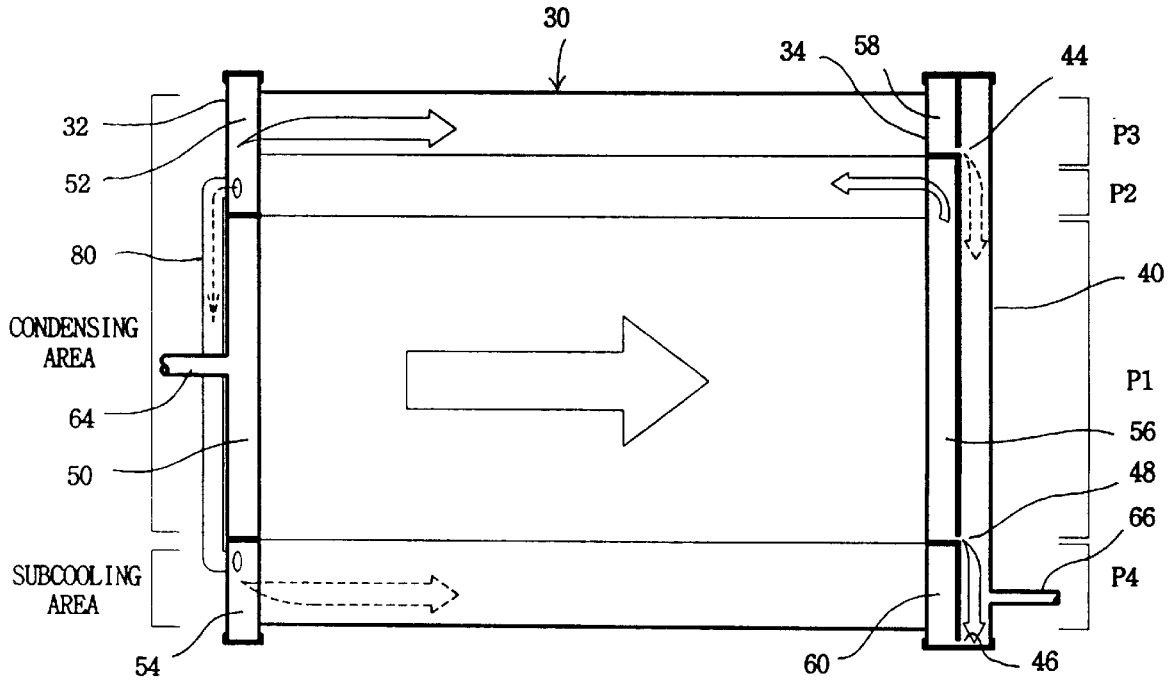
FIG. 7 is a schematic view illustrating flow of the refrigerant in the condenser of FIG. 6.

First of all, referring to FIGS. 6 and 7, the condenser 30 according to the fourth embodiment comprises a first header 32 and a second header 34. As shown well in FIG. 8, each of the headers 32 and 341 consist of two components, and however the configuration of the headers 32, 34 is not restricted thereto. Cylindrical headers can also be employed. A plurality of flat tubes 36 are arranged in parallel with one another between the first and second headers 32 and 34 and connected to the headers 32 and 34 through slots formed in the headers at their opposite ends. A plurality of corrugated fins are interposed between respective pairs of adjacent flat tubes 36. On one hand a bypass conduit 80 is provided with the first header 32, on the other hand a receiver 40 is provided with the second header 34. The condenser 30 further comprises a pair of side plates disposed at the outmost positions. Both ends of each of the first header 32 and the second header 34 with the receiver 40 are closed by blind caps 68.

Each header 32, 34 is provided with partitioning means for dividing the inside space thereof, in this embodiment baffles 42 so that a plurality of refrigerant paths are defined in a relation between the first and second headers 32 and 34 and a plurality of flat tubes 36. Because of provision of the baffles 42, the headers 32, 34 are provided with a plurality of chambers and the refrigerant flows in a zigzag pattern through the paths within the condenser 30. In FIGS. 6 and 7, each header 32, 34 is provided with two baffles 42 and adjustment of the number of baffles 42 results in change of the paths in their numbers. It should be understood that division of the inside space of each header into several chambers may be made by accumulating chambered members each having cavity and sealed at one or both ends, and then by brazing the chambered members.

Two baffles 42 are disposed in the first header 32 in a nonuniform spaced apart relationship and divide the internal space thereof into top, middle, and bottom chambers 52, 50 and 54, respectively. A wall 39, which corresponds to a certain portion of an exterior surface of the second header 34, defines the boundary between the second header 34 and the receiver 40. Two baffles 42 are located in the second header 34 in a nonuniform spaced apart relationship and divide the internal space thereof into upper, central and lower chambers 58, 56 and 60, respectively. Openings formed in upper, middle and lower portions of the wall 39 in connection with the upper, central and lower chambers 58, 56 and 60 of the second header 34 serve as upper, middle and lower communication passageways 44, 48 and 46, respectively. The second header 34 and the receiver 40 are communicated with each other through the communication passageways 44, 46 and 48 so that flow communication of the refrigerant is accomplished between the second header 34 and the receiver 40. Further, a reservoir 62 is provided for storing the refrigerant discharged from the second header 34 between the wall 39 and the receiver 40. An inlet pipe 64 for introducing the refrigerant gas from an external compressor into the condenser 30 is connected to the middle chamber 50 of the first header 32, and an outlet pipe 66 for discharging the refrigerant toward an external climate control system is connected to the receiver 40 adjacent its lower end.

Referring to FIGS. 6 and 7, FIG. 7 is a schematic view illustrating flow of the refrigerant in the condenser of FIG. 6. In this embodiment the condenser 30 has four paths from P1 to P4. Each path P1 to P4 is defined by both chambers 50, 52, 54, 56, 58 and 60 of the headers 32, 34 and a plurality of flat tubes disposed therein. Since the inlet pipe 64 is connected to the middle chamber 50 of the first header 32, a first inlet path P3 is defined from the middle chamber 50 of the first header 32 through a plurality of flat tubes 36 arranged in the middle chamber 50 toward the second header 34. Passing through the inlet path P1, the gaseous refrigerant undergoes condensation and is changed from the gaseous state into the gas/liquid two-phase state.

While the gaseous refrigerant travels upward because of its very active movement and buoyancy due to density difference from the liquid refrigerant, the liquid refrigerant moves downward under the influence of gravity due to high viscosity and large mass and density as compared with the gaseous refrigerant. Accordingly, on one hand, the gaseous refrigerant flows through a plurality of flat tubes which define upper paths P2 and P3 placed above the inlet path P1. The gaseous refrigerant is progressively recondensed passing through the upper paths P2, P3 and supplied to the receiver 40 through the upper communication passageway 44 formed in the upper chamber 58 of the second header 34. On the other hand, liquid or liquid/cool gaseous refrigerant passed through the inlet path P1 is discharged into the receiver 40 through the middle communication passageway 48 formed in the central chamber 56 of the second header 34. Further, some of the liquid refrigerant recondensed passing through the upper paths P2 and P3 above the inlet path P1 travels into the subcooling area, i.e., the outlet path P4 through the bypass conduit 80. One end of the bypass conduit 80 is connected to a place of the upper portion of the first header 32, the upper portion corresponding to the upper paths P2 and P3, and the other end of the bypass conduit 80 is connected to the lower portion of the first header 32 corresponding to the outlet path P4 of the subcooling area. It is preferable that the end of the bypass conduit 80 connected to a place of the upper portion of the first header 32 is joined to a place adjacent the inlet path P1. The refrigerant gas is condensed to a liquid state as it travels through the refrigerant paths P1 to P3 and stored in the receiver 40. The liquid refrigerant in the receiver 40 flows through an outlet path P4 via the lower communication passageway 46 providing a fluid communication between the receiver 40 and the second header 34, and then, exits the condenser 30 through the outlet pipe 66 toward an external climate control system. Arrows shows the direction of flow of the refrigerant in which arrows in solid lines indicate flow of the gaseous refrigerant and arrows in dotted lines indicate flow of the liquid refrigerant.

In this embodiment of FIGS. 6 and 7, the inlet path P1 and the upper paths p2, P3 define a condensing area, while the outlet path P4 defines a subcooling area. The condensing area has a cross-sectional area corresponding to 70–80% of the overall effective cross-sectional area of the condenser, while the subcooling area has 20–30% of the overall effective cross-sectional area of the condenser. The inlet path P1 is arranged to have the largest effective cross-sectional area of the condensing area, preferably 30–50% thereof.

The refrigerant flowing through the outlet path P4 of the subcooling area maintains substantially a liquid state since the refrigerant introduced into the outlet path P4 through the bypass conduit 80 has been changed sufficiently into a liquid state while traveling through the condensing area of the condenser 30. Further, since the liquid refrigerant of the outlet path p4 is discharged into the receiver 40 through the lower communication passageway 46 and thereafter exits the condenser 30 through the outlet pipe 66 in the mixture with other liquid refrigerant stored in the receiver 40, the refrigerant is prevented from rapidly flowing from the outlet path P4 into the receiver 40 and from being swept along with the liquid refrigerant exiting through the outlet pipe 66 when the size of the lower communication passageway 46 is enough small. Enough small size of the passageway 46 makes it hard for the gaseous refrigerant maybe contained in the refrigerant passing through the outlet path P4 to escape the lower communication passageway 46. Moreover, the receiver 40 has a given amount of the liquid refrigerant condensed passing through paths so that the gaseous refrigerant introduced into the receiver 40 is recondensed in connection with the liquid refrigerant stored in the receiver 40. In addition, the receiver 40 may include a desiccant and a filter for removing water and dust from the refrigerant. (not shown in FIGS. 6, 7)

For the condenser 30 according to the embodiment, of FIGS. 6 and 7, the refrigerant gas is introduced from an external compressor and condensed, during passage through the inlet path P1, from the gaseous state into the gas/liquid two-phase state as the heat exchange occurs between the condenser and the atmospheric air flowing through the corrugated fins in the direction normal to a front plane of the condenser. Then, separation of the gaseous and liquid phases of the refrigerant takes place in the first place within the central chamber 56 of the second header 34. The separated gaseous refrigerant is introduced into the upper paths P2 and P3 above the inlet path P1 and the separated liquid refrigerant flows into the receiver 40 through the middle communication passageway 48. The gaseous refrigerant is recondensed into a liquid state as it travels through the upper paths P2 and P3, and further discharged into the receiver 40 via the upper communication passageway 44 provided with the upper chamber 58 of the second header 34. Furthermore, some of the liquid refrigerant which is condensed passing through the upper paths P2 and P3 and exists in the top chamber 52 of the first header 32 travels through the bypass conduit 80 into the outlet path P4 of the subcooling area. Such bypass of the liquid refrigerant existing in the top chamber 52 allows the flow resistance of the refrigerant within the condenser 30 to be reduced. The refrigerant enters into the condenser 30 in gaseous state, and during passage through the paths of the condenser, is condensed progressively into a liquid state. The condensed liquid refrigerant acts as obstacle to the flow of liquid or liquid/gaseous refrigerant in view of the overall flow of the refrigerant within the condenser because the liquid refrigerant has a very high viscosity and density as compared with the gaseous refrigerant. The flow resistance of the refrigerant occurring in the paths is reduced by transferring the condensed liquid refrigerant into the outlet path P4 through the bypass conduit 80.

Some of the refrigerant stored in the receiver 40 may exist in a gaseous state, but such gaseous refrigerant is scarcely introduced into the receiver 40 through the lower communication passageway 46 since the lower communication passageway 46 is enough small and a given amount of the refrigerant is maintained in the receiver 40 after operation of a refrigerant system. The liquid refrigerant stored in the receiver 40 serves as a boundary surface between the gaseous refrigerant and the liquid refrigerant. Therefore, the refrigerant flowing through the outlet path P4 maintains substantially a liquid state. Consequently, phase separation effect between the gaseous refrigerant and the liquid refrigerant occurs again in the receiver 40. With the bypass conduit 80, though the gaseous refrigerant may flow therethrough to some degree together with the liquid refrigerant, in this embodiment the number of flat tubes 36 constituting the outlet path P4 is of small number to ensure prevention of rapid flow of the refrigerant from the outlet path P4 toward the outlet pipe 66 and to prevent the refrigerant of the outlet path P4 from being swept along with the liquid refrigerant exiting through the outlet pipe 66. Furthermore, the size of the lower communication passageway 46 through which the refrigerant flows from the outlet path P4 into the receiver 40 is enough small so that controlled flow of the refrigerant is achieved once more. Such controlled flow of the refrigerant and a given amount of the liquid refrigerant stored in the receiver 40 allow mainly the liquid refrigerant to flow through the outlet path P4 after operation of the refrigeration system.

Figure 8:
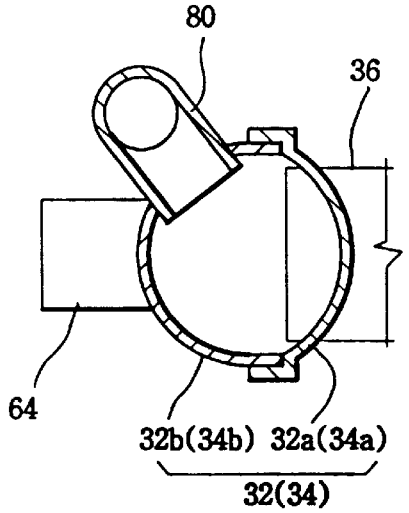
FIG. 8 is a cross-sectional view showing the connection of an inlet pipe and a bypass conduit to a header taken along line A—A in FIG. 6.

FIG. 8 is a cross-sectional view showing the connection of an inlet pipe and a bypass conduit to a header taken along line A—A in FIG.6, wherein each header 32, 34 consists of two members of a first member 32*a* or 34*a* and a second member 32*b* or 34*b*. The first and second members form together an elliptical cross-section. The headers 32, 34 may be formed to have a cylindrical cross-section. Each flat tube 36 is inserted at its both ends into slots, respectively, formed in the first member 32*a* or 34*a*. The inlet pipe and the bypass conduit 80 are connected in cross each other to the second member 32*b* or 34*b*, respectively. It is preferable that the inlet pipe 64 is disposed to maintain an orthogonal relationship between the header 32 or 34 and the flat tubes 36 for smooth flow of the refrigerant between the header and the flat tubes.

Figure 9:
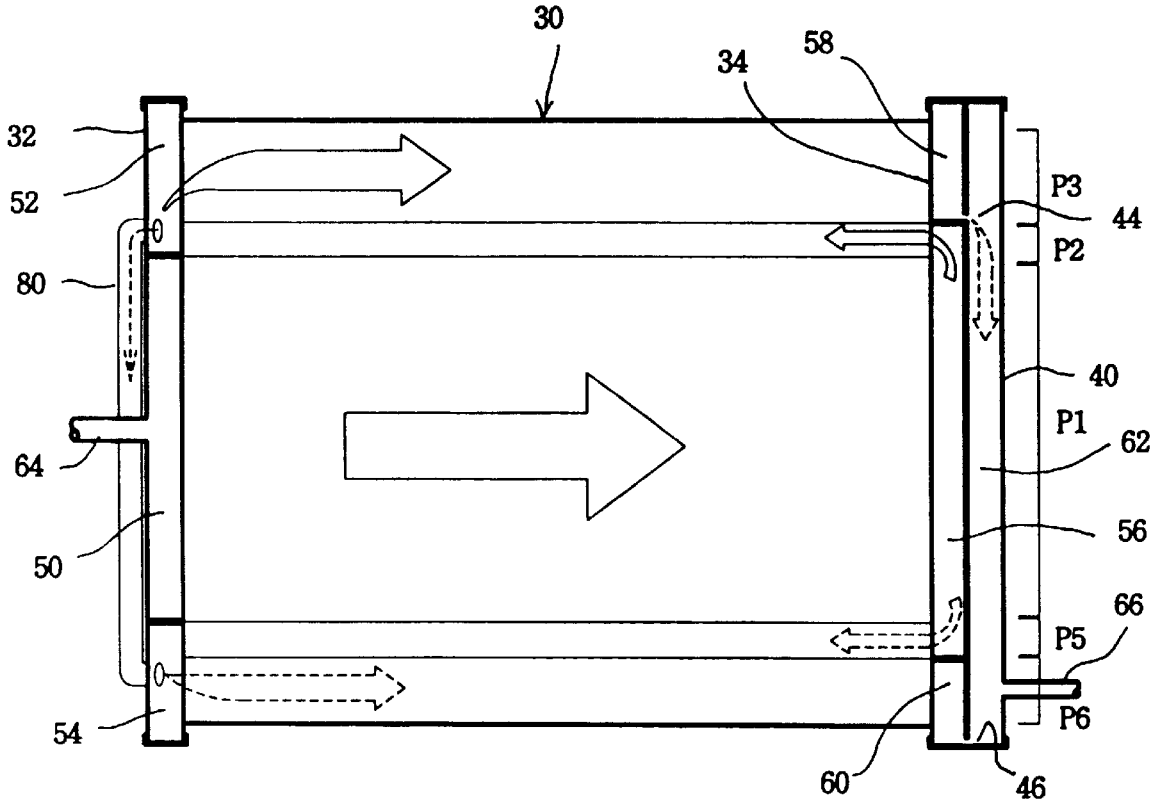
FIG. 9 is a schematic view of a multistage gas and liquid separation type condenser having a bypass conduit according to further another embodiment of the present invention, illustrated in view of flow of the refrigerant based on the condenser of FIG. 6.

FIG. 9 illustrates a condenser in accordance with the fifth embodiment of the present invention which is a modification of the condender of FIGS. 6 to 8, wherein like elements are designated by like numerals. The condenser according to this embodiment of FIG. 9 is different from the condenser of FIGS. 6 to 8 in that a lower path P5 is added between the inlet path P1 and the outlet path P4 by crossing the lowermost baffles in each header 32, 34, and no communication passageway is formed in the central chamber 56 of the second header 34 except the upper and lower communication passageways 44 and 46.

In operation of condenser 30, compressed refrigerant gas from an external compressor flows through the inlet path P1, and then, the first separation of the gaseous and liquid phases of the refrigerant occurs within the central chamber 56 of the second header 34. The gaseous refrigerant is recondensed flowing through the upper paths P2 and P3 above the inlet path P1, and supplied to the receiver 40 through the upper communication passageway 44 formed in the upper chamber 58 of the second header 34. In the meantime, the liquid or liquid/cool gaseous refrigerant passed through the inlet path P1 is recondensed and/or subcooled flowing through the lower path P5 below the inlet path P1, and flows into the outlet path P4. Some of the liquid refrigerant condensed from the gaseous state into the liquid state through the upper paths P2 and P3 is introduced into the outlet path P4 through the bypass conduit 80. The refrigerant passed through the outlet path P4 further flows into the receiver 40 through the lower communication passageway 46 formed in the lower chamber 60 of the second header 34, and then exits the condenser 30 through the outlet pipe 66 mixing with the liquid refrigerant existent in the receiver 40.

Some of the refrigerant stored in the receiver 40 may exist in a gaseous state, but such gaseous refrigerant is scarcely introduced into the receiver 40 through the lower communication passageway 46 since the lower communication passageway 46 is enough small and a given amount of the liquid refrigerant is maintained in the receiver 40 after operation of a refrigerant system. The liquid refrigerant stored in the receiver 40 serves as a boundary surface between the gaseous refrigerant and the liquid refrigerant. Therefore, the refrigerant flowing through the outlet path P4 maintains substantially a liquid state. Consequently, phase separation effect between the gaseous refrigerant and the liquid refrigerant occurs again in the receiver 40. Even for the lower path P5, though the gaseous refrigerant may flow therethrough to some degree together with the liquid refrigerant, the gaseous refrigerant flows hardly through the outlet path P5 because of the facts that the number of flat tubes 36 constituting the lower path P4 and the outlet path P4 is of small number to ensure prevention of rapid flow of the refrigerant from the outlet path P4 toward the outlet pipe 66, a given amount of the liquid refrigerant is maintained in the receiver 40, by which rapid flow of the refrigerant from the outlet path P4 toward the outlet pipe 66 is prevented again, and enough small size of the lower communication passageway 46 by which rapid flow of the refrigerant from the outlet path P4 toward the outlet pipe 66 is prevented once more. Therefore, mainly the liquid refrigerant flows through the outlet path P4. With the bypass conduit 80, though the gaseous refrigerant may flow therethrough to some degree together with the liquid refrigerant, substantially the liquid refrigerant flows through the outlet path P4 because of the facts enumerated above in relation to the probable gaseous refrigerant flow through the lower path P5 into the outlet path P4.

Figure 10A:
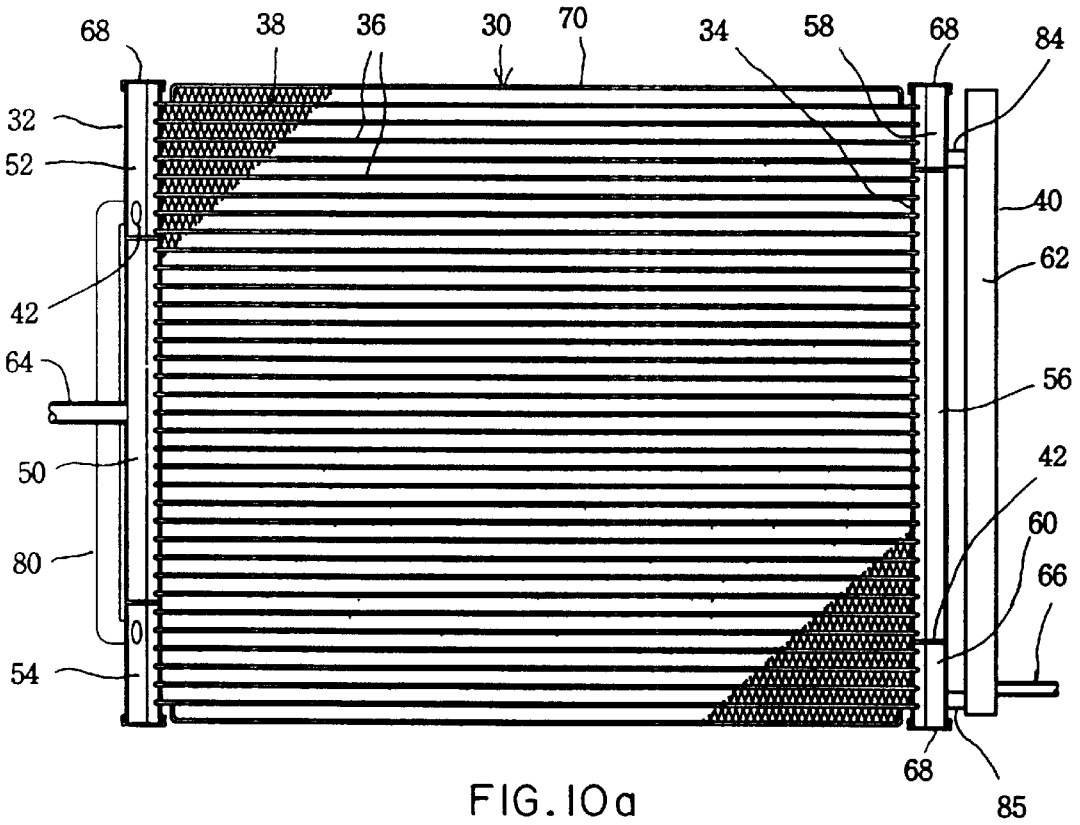
FIGS. 10*a* and 10*b* are views of the condenser especially illustrating a relationship of connection between a header and a receiver in the condenser according to the present invention.
Figure 10B:
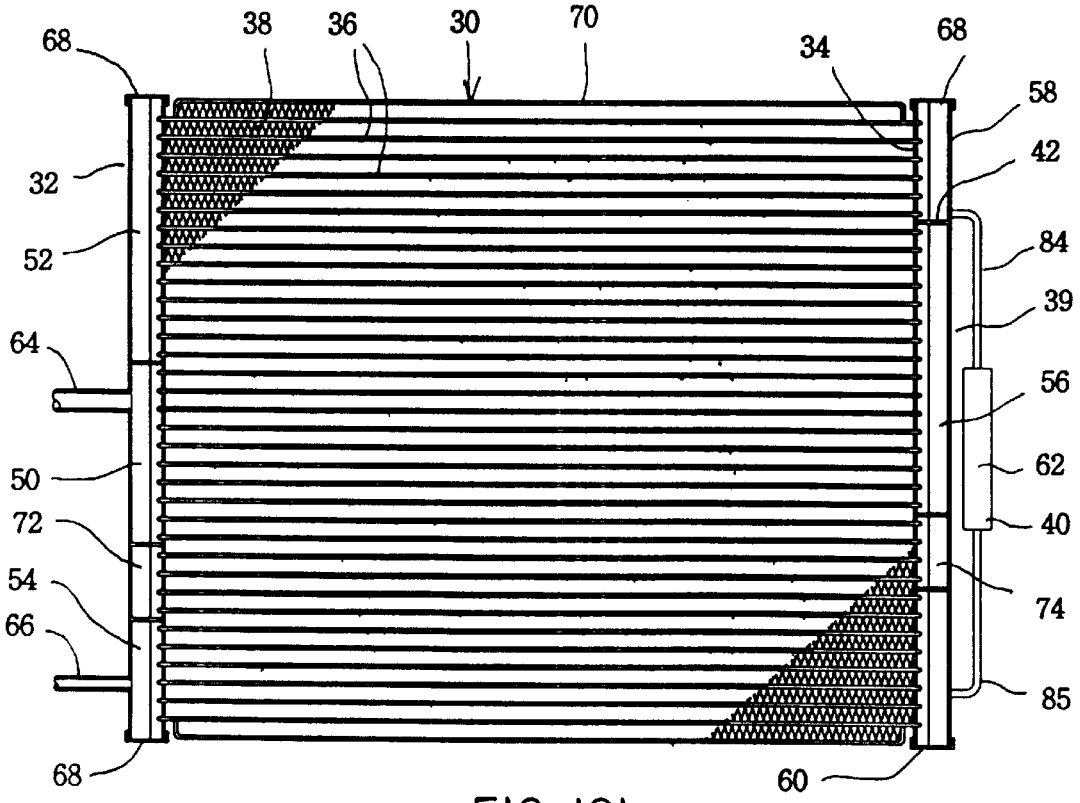

FIGS. 10*a* and 10*b* show a condenser in accordance with the sixth embodiment of the invention which is based on the embodiment according to FIGS. 6 and 9, and FIG. 2, respectively. However, the embodiment according to FIG. 10 can be applied to other embodiments of the present invention. Referring to FIG. 10*a,* the condenser 30 includes a pair of headers 32 and 34 disposed in parallel each other, a plurality of flat tubes 36 arranged in parallel with one another and having their opposite ends connected to the headers 32 and 34, a plurality of corrugated fins 38 interposed between respective pairs of adjacent flat tubes 36, a pair of side plates 70, and blind caps closing the both ends of headers 32 and 34. Two baffles 42 are disposed in the header 32 and 34, respectively, so as to provide multiple paths with the condenser 30. Because of the provision of the baffles 42, the internal space of the first header 32 is divided into top, middle and bottom chambers 52, 50 and 54 and the internal space of the second header 34 is divided into upper, central and lower chambers 58, 56 and 60. The first header 32 is provided with an inlet pipe 64 connected to the middle chamber 50 thereof, and a bypass conduit 80 having one end connected to the top chamber 52 and the other end connected to the bottom chamber 54 thereof. The second header 34 is provided with a receiver 40 connected to the second header 34 via a pair of coupling conduits 84 and 85 through which a fluid communication between the second header 34 and the receiver 40 is provided. The upper coupling conduit 84 is arranged between the upper chamber 58 of the second header 34 and the opposite place of the receiver 40, and the lower coupling conduit 85 is disposed between the lower chamber 60 of the second header 34 and the opposite place of the receiver 40. The receiver 40 has an outlet pipe 66 adjacent its, lower end. It is preferable that the inside diameters of the coupling conduits, 84 and 85 are enough small, for example, for the upper coupling conduit 84, 1–8 mm and for the lower coupling conduit 85, 8–13 mm.

Flow of the refrigerant in the condenser 30 in accordance with the embodiment of FIG. 10*a* is the same as that in the condenser according to the embodiment of FIG. 9 except that the fluid communication between the second header 34 and the receiver 40 is performed through coupling conduits 84 and 85. Further, as shown in FIG. 10*b*, one end of the upper coupling conduit 84 may be connected to the top surface of the receiver 40 and one end of the lower coupling conduit 85 may be connected to the bottom surface of the receiver 40, in which case the longitudinal length of the receiver 40 is smaller than that of the second header 34.

Figure 11:
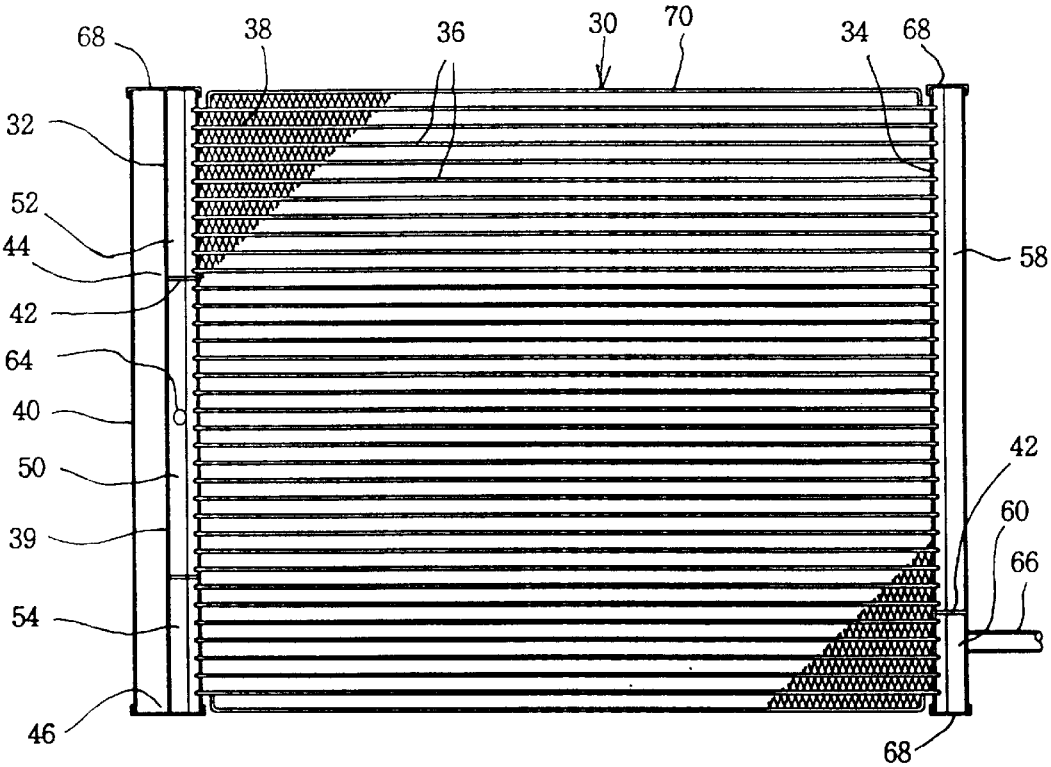
FIG. 11 is an entire cross-sectional view of a multistage gas and liquid phase separation type condenser according to further another embodiment of the present invention.
Figure 12:
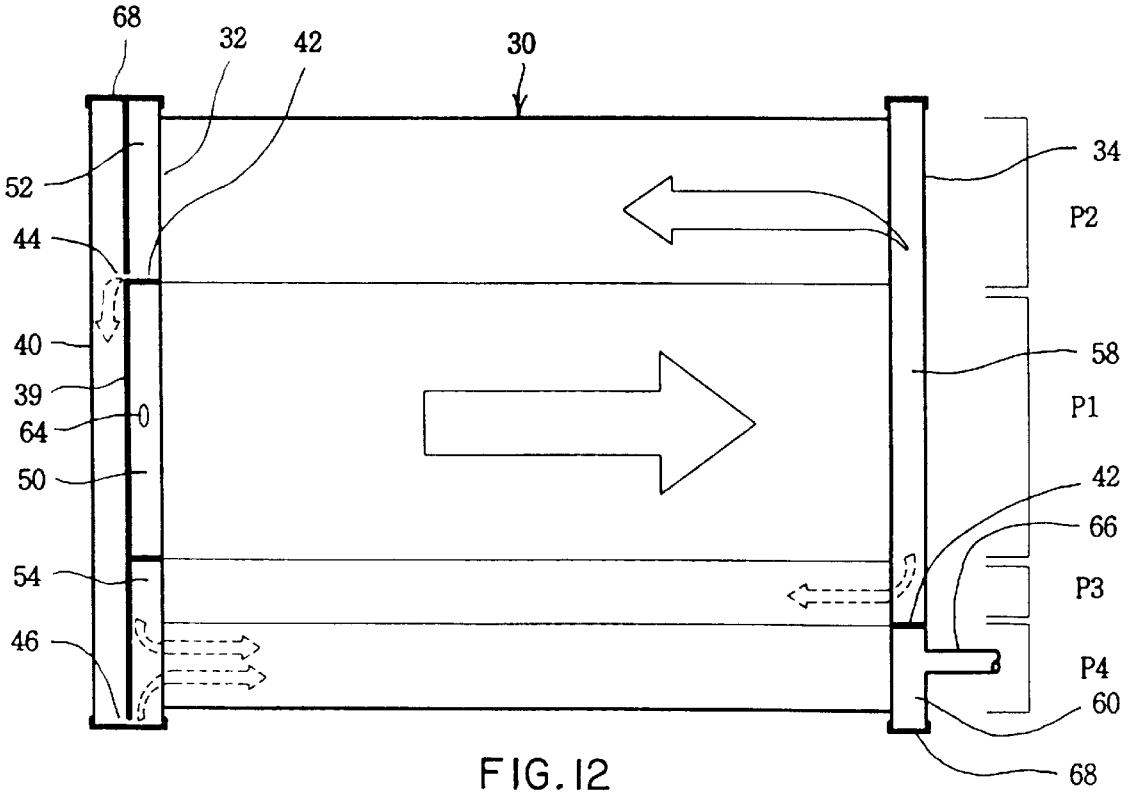
FIG. 12 is a schematic view illustrating flow of the refrigerant in the condenser of FIG. 11.

With reference to FIGS. 11 and 12, a condenser in accordance with the seventh embodiment of the invention is shown, wherein elements similar to elements of other embodiments are indicated by like numerals. In the seventh embodiment, the condenser 30 includes a pair of headers 32 and 34 disposed in parallel each other, a plurality of flat tubes 36 arranged in parallel with one another and having their opposite ends connected to the headers 32 and 34, a plurality of corrugated fins 38 interposed between respective pairs of adjacent flat tubes 36, a pair of side plates 70, and blind caps closing the both ends of headers 32 and 34. The first header 32 is provided with two baffles 42 and the second header 34 is provided with one baffle 42. Because of the provision of the baffles 42, the internal space of the first header 32 is divided into top, middle and bottom chambers 52, 50 and 54 and the internal space of the second header 34 is divided into upper and lower chambers 58 and 60. The first header 32 is provided with an inlet pipe 64 connected to the middle chamber 50 thereof, and a receiver 40. A wall 39, which corresponds to some portion of an exterior surface of the first header 32, defines the boundary between the first header 32 and the receiver 40. Both ends of the receiver 40 are sealed by the blind caps 68 together with the ends of the first header 32.

For liquid communications between the first header 32 and the receiver 40, the condenser 30 are provided with an upper communication passageway 44 between the top chamber 52 of the first header 32 and the receiver 40, and a lower communication passageway 46 between the bottom chamber 54 and the receiver 40. With the arrangement between the inlet pipe 64 and the receiver 40 both which are formed in the first header 32, FIG. 8 will be referenced. The lower chamber 60 of the second header 34 is provided with an outlet pipe 66.

Referring to FIG. 11 together with FIG. 12, FIG. 12 is a schematic view illustrating flow of the refrigerant in the condenser of FIG. 11. In this embodiment, the condenser 30 has four paths from P1 to P4. Each path P1 to P4 is defined by both chambers 50, 52, 54, 58 and 60 of the headers 32, 34 and a plurality of flat tubes disposed therein. Since the inlet pipe 64 is connected to the middle chamber 50 of the first header 32, an inlet path P1 is defined from the middle chamber 50 of the first header 32 through a plurality of flat tubes 36 arranged in the middle chamber 50 toward the second header 34. Passing through the inlet path P1, the gaseous refrigerant undergoes condensation and is condensed from the gaseous state into the gas/liquid two-phase state.

While the gaseous refrigerant travels upward because of its very active movement and buoyancy due to density difference from the liquid refrigerant, the liquid refrigerant moves downward under the influence of gravity due to high viscosity and large mass and density as compared with the gaseous refrigerant. Accordingly, the gaseous refrigerant flows through a plurality of flat tubes which define an upper path P2 placed above the inlet path P1. The liquid refrigerant is progressively recondensed passing through the upper path P2 and supplied to the receiver 40 through the upper communication passageway 44 formed in the top chamber 52 of the first header 32. In the meantime, the liquid or liquid/cool gaseous refrigerant passed through the inlet path P1 is recondensed and/or subcooled flowing through a lower path P3 below the inlet path P1 and further flows through an outlet path P4. In the embodiment of FIGS. 11 and 12, no communication passageway is formed in the middle chamber 50 of the first header 32. The refrigerant gas is recondensed to a liquid state as it travels through the refrigerant path P2 and discharged into the receiver 40 via the upper communication passageway 44 formed in the top chamber 52 of the first header 32. The liquid refrigerant in the receiver 40 flows through the outlet path P4 via the lower communication passageway providing a fluid communication between the receiver 40 and the first header 32, and then, exits the condenser 30 through the outlet pipe 66 toward an external climate control system. Arrows shows the direction of flow of the refrigerant in which arrows in solid lines indicate flow of the gaseous refrigerant and arrows in dotted lines indicate flow of the liquid refrigerant.

In this embodiment of FIGS. 11 and 12 the condensing area, the subcooling area and the shapes and sizes of the communication passageways will be referenced to those in the embodiment in accordance with FIGS. 2 and 3.

For the condenser 30 according to the embodiment of FIGS. 11 and 12, the refrigerant gas is introduced from an external compressor and condensed, during passage through the inlet path P1, from the gaseous state into the gas/liquid two-phase state as the heat exchange occurs between the condenser and the atmospheric air flowing through the corrugated fins in the direction normal to a front plane of the condenser. Then, separation of the gaseous and liquid phases of the refrigerant takes place in the first place within the upper chamber 58 of the second header 34. The separated gaseous refrigerant is introduced into the upper path P2 above the inlet path P1, while the separated liquid refrigerant flows into the lower path P3 below the inlet path P1. The gaseous refrigerant is recondensed into a liquid state as it travels through the upper path P2, and further discharged into the receiver 40 via the upper communication passageway 44 provided with the top chamber 52 of the first header 32. The refrigerant stored in the receiver 40 flows through the outlet path P4 via the lower communication passageway 46 formed in the bottom chamber 54 of the first header 32.

Some of the refrigerant stored in the receiver 40 may exist in a gaseous state, but such gaseous refrigerant is scarcely introduced into the outlet path P4 through the lower communication passageway 46 since the lower communication passageway 46 is enough small and a given amount of the liquid refrigerant is maintained in the receiver 40 after operation of a refrigerant system. The liquid refrigerant stored in the receiver 40 serves as a boundary surface between the gaseous refrigerant and the liquid refrigerant. Therefore, the refrigerant flowing through the outlet path P4 via the bottom chamber 54 of the first header 32 and the lower communication passageway 46 maintains substantially a liquid state. Consequently, phase separation effect between the gaseous refrigerant and the liquid refrigerant occurs again in the receiver 40. Even for the lower path P3, though the gaseous refrigerant may flow therethrough to some degree together with the liquid refrigerant and therefore a liquid/gas mixture may flow the outlet path P4, flow of the gaseous refrigerant into the adjusting path P4 can be effectively prevented by adjusting the size of the lower communication passageway 46 and by adjusting the number of flat tubes 36 constituting the lower and outlet paths P3 and P4 in order to ensure prevention of rapid flow of the refrigerant from the outlet path P4 toward the outlet pipe 66 and to prevent the refrigerant of the outlet path P4 from being swept along with the liquid refrigerant exiting through the outlet pipe 66. Further the second header may have a desiccant/filter disposed in the lower chamber 60 thereof so as to prevent the gaseous refrigerant from exiting the condenser 30 through the outlet pipe 66.

Figure 13:
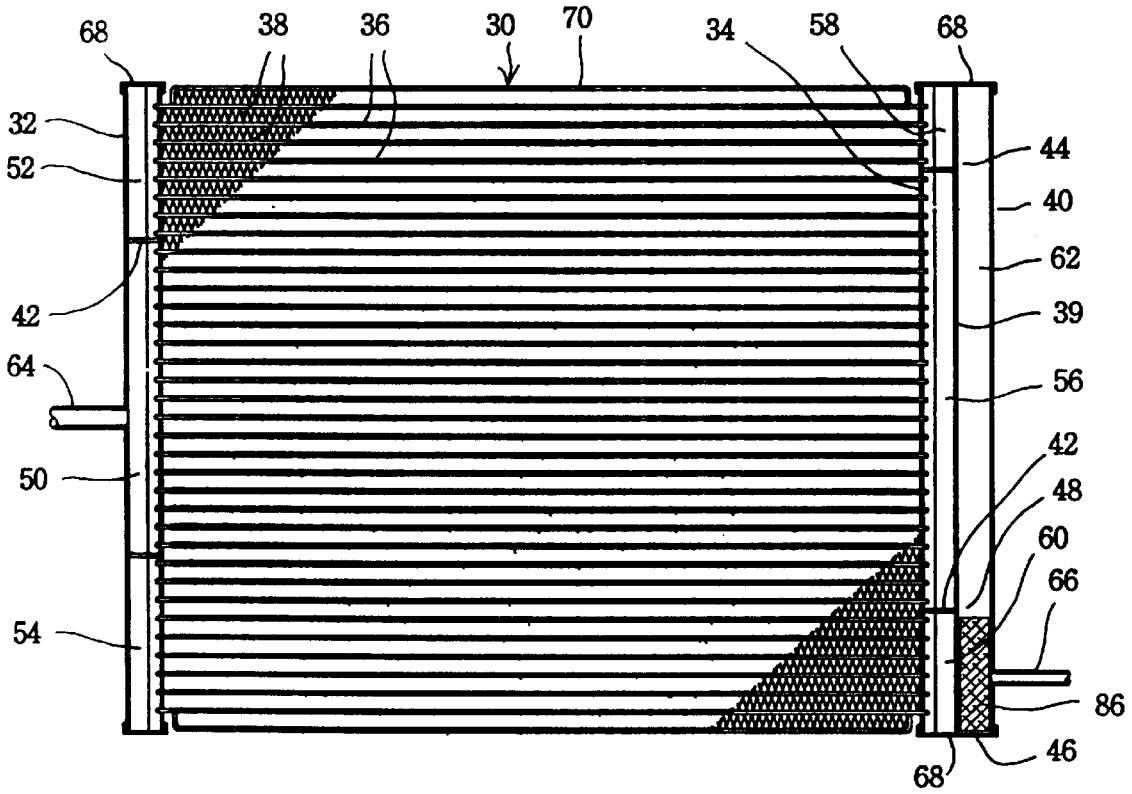
FIG. 13 is an entire cross-sectional view showing a desiccant installed in the receiver of the condenser according to one embodiment of the present invention.

FIG. 13 is an entire cross-sectional view showing a desiccant installed in the condenser, wherein this embodiment is based on the embodiment depicted in FIG. 6 except the bypass conduit. Preferably, the desiccant 86 is arranged to cover an inlet port of an outlet pipe 66. Otherwise, the desiccant 86 may be disposed in the lower chamber 60 of the second header 34. Such filtering means removes impurities such as water, dust and gaseous refrigerant contained in the refrigerant, except the liquid refrigerant.

What is claimed is:

1. A multistage gas and liquid phase separation type condenser, comprising:

a first header having at least three chambers;

a second header having at least two chambers and disposed in parallel with said first header;

a plurality of tubes each connected to said headers at opposite ends thereof;

a plurality of fins each fin disposed between adjacent tubes;

a receiver provided with one of the headers;

a refrigerant inlet provided with a middle chamber of said first header;

a refrigerant outlet provided with one of said headers or said receiver;

the refrigerant being introduced through said inlet and exiting the condenser through said outlet;

the refrigerant flowing through a first path defined through a plurality of tubes, a second path located above said first path and defined through a plurality of tubes for recondensing a gaseous refrigerant of the refrigerant passed through said first path, and a third path located below said first path and defined through a plurality of tubes for allowing a liquid refrigerant of the refrigerant passed through said first path to flow therethrough;

a first separation of gaseous and liquid phases of the condensation-progressed refrigerant passing through said first path occurring within said second header so that the separated gaseous refrigerant is recondensed flowing through said second path and thereafter introduced into said receiver via an upper communication passageway provided between an upper chamber of the header with said receiver and said receiver, while the separated liquid refrigerant flows through said third path toward said outlet;

a fluid communication between said receiver and the header with said receiver being made via a lower communication passageway provided between a lower chamber of the header with said receiver and said receiver; and a second separation of gaseous and liquid phases of the refrigerant introduced into said receiver occurring in connection with a certain amount of the liquid refrigerant existing within said receiver.

2. The condenser of claim 1, wherein the chambers of said first and second headers are defined by partition plates.

3. The condenser of claim 1, wherein said second path includes at least two paths each defined by a plurality of tubes.

4. The condenser of claim 1, wherein said third path includes at least two paths each defined by a plurality of tubes.

5. The condenser of claim 1, wherein said second and third paths each includes at least two paths defined by a plurality of tubes, respectively.

6. The condenser of claim 5 further comprising a bypass conduit provided with the opposite header to the header with said receiver for providing a fluid communication between said second path and said third path.

7. The condenser of claim 1, wherein said upper and lower communication passageways each is an opening formed in the header with said receiver.

8. The condenser of claim 1, wherein said upper and lower communication passageways each is a conduit formed between the header with said receiver and said receiver.

9. The condenser of claim 1 further comprising filtering means disposed within said receiver for removing impurities from the refrigerant except liquid refrigerant.

10. The condenser of claim 1 further comprising a bypass conduit provided with the opposite header to the header with said receiver for providing a fluid communication between said second path and said third path.

11. The condenser of claim 1, wherein said lower communication passageway is enough small to prevent the refrigerant existing in said receiver from being rapidly communicated between said receiver and said lower chamber of the header with said receiver.

12. The condenser of claim 11, wherein the number of tubes constituting said third path is also enough small to ensure prevention of rapid flow of the refrigerant from said third path toward said outlet.

13. The condenser of claim 1, wherein the number of tubes constituting said third path is enough small to ensure prevention of rapid flow of the refrigerant from said third path toward said outlet.

14. A multistage gas and liquid phase separation type condenser, comprising:

a first header having at least three chambers;

a second header having at least three chambers and disposed in parallel with said first header;

a plurality of tubes each connected to said headers at opposite ends thereof;

a plurality of fins each fin disposed between adjacent tubes;

a receiver provided with said second header;

a refrigerant inlet provided with a middle chamber of said first header;

a refrigerant outlet provided with said first header;

the refrigerant being introduced through said inlet and exiting the condenser through said outlet;

the refrigerant flowing through a first path defined through a plurality of tubes, a second path located above said first path and defined through a plurality of tubes for recondensing a gaseous refrigerant of the refrigerant passed through said first path, and a third path located below said first path and defined through a plurality of tubes;

a first separation of gaseous and liquid phases of the condensation-progressed refrigerant passing through said first path occurring within said second header so that the separated gaseous refrigerant is recondensed flowing through said second path and thereafter introduced into said receiver via an upper communication passageway provided between an upper chamber of said second header and said receiver, while the separated liquid refrigerant is introduced into said receiver via a middle communication passageway provided between a middle chamber of said second header and said receiver;

a second separation of gaseous and liquid phases of the refrigerant introduced into said receiver occurring in connection with a certain amount of the liquid refrigerant existing within said receiver; and the liquid refrigerant existing within said receiver flowing into said third path via a lower communication passageway provided between a lower chamber of said second header and said receiver.

15. The condenser of claim 14, wherein the chambers of said first and second headers are defined by partition plates.

16. The condenser of claim 14, wherein said second path includes an even number of paths each defined by a plurality of tubes.

17. The condenser of claim 14, wherein said middle communication passageway is located adjacent a lower end of said middle chamber of said second header, each of the middle chambers of said first and second headers is further divided into two chambers so as to form an additional path defined by a plurality of tubes between said first path and said third path, said inlet is provided in a top chamber of the divided middle chamber of said first header, and a separation of gaseous and liquid phases of the condensation-progressed refrigerant passing through said first path takes place within said second header so that the separated gaseous refrigerant is recondensed flowing through said second path and thereafter introduced into said receiver via said upper communication passageway provided between said upper chamber of said second header and said receiver, while the separated liquid refrigerant flows through said additional path and then is introduced into said receiver via said middle communication passageway.

18. The condenser of claim 17, wherein said additional path is made up of two paths each defined by a plurality of tubes.

19. The condenser of claim 14 further comprising, filtering means disposed within said receiver for removing impurities from the refrigerant except liquid refrigerant.

20. The condenser of claim 14, wherein said upper, middle and lower communication passageways each is an opening formed in the header having said receiver.

21. The condenser of claim 14, wherein said upper, middle and lower communication passageways each is a conduit connected between the header having said receiver and said receiver.

22. The condenser of claim 14, wherein said lower communication passageway is enough small to prevent the refrigerant existing in said receiver from being rapidly communicated between said receiver and said lower chamber of said second header.

23. The condenser of claim 22, wherein the number of tubes constituting said third path is also enough small to ensure prevention of rapid flow of the refrigerant from said third path toward said outlet.

24. The condenser of claim 14, wherein the number of tubes constituting said third path is enough small to ensure prevention of rapid flow of the refrigerant from said third path toward said outlet.

25. A multistage gas and liquid phase separation type condenser, comprising:

a first header having at least three chambers;

a second header having at least three chambers and disposed in parallel with said first header;

a plurality of tubes each connected to said headers at opposite ends thereof;

a plurality of fins each fin disposed between adjacent tubes;

a receiver provided with said second header;

a refrigerant inlet provided with a middle chamber of said first header;

a refrigerant outlet provided with said first header or said receiver;

a bypass conduit provided with said first header;

the refrigerant being introduced through said inlet and exiting the condenser through said outlet;

the refrigerant flowing through a first path defined through a plurality of tubes, a second path located above said first path and defined through a plurality of tubes for recondensing a gaseous refrigerant of the refrigerant passed through said first path, and a third path located below said first path and defined through a plurality of tubes;

said bypass conduit being arranged for placing the second and third paths in flow communication;

a first separation of gaseous and liquid phases of the condensation-progressed refrigerant passing through said first path occurring within said second header so that the separated gaseous refrigerant is recondensed flowing through said second path and thereafter introduced into said receiver via an upper communication passageway provided between an upper chamber of said second header and said receiver, while the separated liquid refrigerant is introduced into said receiver via a middle communication passageway provided between a middle chamber of said second header and said receiver;

a second separation of gaseous and liquid phases of the refrigerant introduced into said receiver occurring in connection with a certain amount of the liquid refrigerant existing within said receiver;

the liquid refrigerant existing in said receiver flowing through said third path via a lower communication passageway provided between a lower chamber of said second header and said receiver; and some of the recondensed refrigerant passing through said second path flowing through said third path via said bypass conduit.

26. The condenser of claim 25, wherein the chambers of said first and second headers are defined by partition plates.

27. The condenser of claim 25, wherein said outlet is located adjacent a lower end of said receiver.

28. The condenser of claim 25, wherein said third path is made up of two paths each defined by a plurality of tubes by diving a lower chamber of said first header by means of partitioning means, and one end of said bypass conduit connected to said third path is coupled of said two paths to the path adjacent said first path.

29. The condenser of claim 25 further comprising filtering means disposed within said receiver for removing impurities from the refrigerant except liquid refrigerant.

30. The condenser of claim 25, wherein said middle communication passageway is located adjacent a lower end of said middle chamber of said second header, each of the middle chambers of said first and second header is further divided into two chambers so as to form an additional path defined by a plurality of tubes between said first path and said third path, said inlet is provided in a top chamber of the divided middle chamber of said first header, and a separation of gaseous and liquid phases of the condensation-progressed refrigerant passing through said first path takes place within said second header so that the separated gaseous refrigerant is recondensed flowing through said second path, while the separated liquid refrigerant flows through said additional path and then is introduced into said receiver via said middle communication passageway.

31. The condenser of claim 25, wherein said lower communication passageway is enough small to prevent the refrigerant existing in said receiver from being rapidly communicated between said receiver and said lower chamber of said second header.

32. The condenser of claim 31, wherein the number of tubes constituting said third path is also enough small to ensure prevention of rapid flow of the refrigerant from said third path toward said outlet.

33. The condenser of claim 25, wherein the number of tubes constituting said third path is enough small to ensure prevention of rapid flow of the refrigerant from said third path toward said outlet.

* * * * *